US009895030B1

(12) United States Patent
Curtis

(10) Patent No.: US 9,895,030 B1
(45) Date of Patent: Feb. 20, 2018

(54) SEAT

(71) Applicant: Bonita K. Curtis, Henderson, NV (US)

(72) Inventor: Bonita K. Curtis, Henderson, NV (US)

( * ) Notice: Subject to any disclaimer, the term of this patent is extended or adjusted under 35 U.S.C. 154(b) by 79 days.

(21) Appl. No.: 14/871,043

(22) Filed: Sep. 30, 2015

Related U.S. Application Data

(60) Provisional application No. 62/122,616, filed on Oct. 27, 2014.

(51) Int. Cl.

| | |
|---|---|
| ***A47K 3/00*** | (2006.01) |
| ***A47K 3/28*** | (2006.01) |
| ***A47C 4/54*** | (2006.01) |
| ***A47C 7/62*** | (2006.01) |
| ***A47C 16/02*** | (2006.01) |
| ***A47C 5/12*** | (2006.01) |

(52) U.S. Cl.
CPC ..... *A47K 3/282* (2013.01); *A47C 4/54* (2013.01); *A47C 5/12* (2013.01); *A47C 7/62* (2013.01); *A47C 16/02* (2013.01)

(58) Field of Classification Search
CPC ..... A47K 3/282; A47C 4/54
USPC ..... 4/611
See application file for complete search history.

(56) References Cited

U.S. PATENT DOCUMENTS

| | | | | |
|---|---|---|---|---|
| 5,855,028 | A * | 1/1999 | Colbert | A61G 7/1003 4/563.1 |
| 5,896,598 | A * | 4/1999 | Jeans | A61G 7/1003 4/566.1 |
| 6,378,147 | B1 * | 4/2002 | Halleran | A47K 3/002 297/16.1 |
| 2008/0196157 | A1 * | 8/2008 | Ray | A47K 3/282 4/611 |
| 2010/0170037 | A1 * | 7/2010 | Fletcher | A47C 4/54 5/83.1 |

* cited by examiner

*Primary Examiner* — Huyen Le
(74) *Attorney, Agent, or Firm* — Legends Law Group; Stephen H. Bean, Esq.

(57) ABSTRACT

A new seat is provided. the seat is lightweight, flexible, and water resistant for use in a bathtub, shower, or other aquatic environment. There are deformable projections on the top and bottom of of the seat that both cushion a user and provide gripping action against a supporting surface. The top and bottom of the seat are substantially planar.

19 Claims, 6 Drawing Sheets

SEAT

FIELD OF THE INVENTION

The present invention relates to a new seat. The seat is lightweight, flexible, and water resistant, such that it may be used in a bathtub, shower, or other aquatic environment to provide a safe place to sit without risk of injury. The seat is characterized by concave projections that are both functional and decorative. The projections grip the surface on which the seat is placed and also provide a cushioned seating area for the user.

BACKGROUND OF THE INVENTION

Bathroom seats and footstools are well-known in the prior art. For example, Tones teaches a shaving foot support for use in a bathtub or shower in U.S. Pat. No. 5,920,926. In this reference, a four-legged foot-support with a contoured recess for a foot is shown. The recess helps prevent the foot from slipping while the bather is shaving a leg. In U.S. Pat. No. 5,640,723 by Stanek, a portable shower stool with a storage compartment is disclosed. In this reference, a four-legged structure is provided with compartments for storing shaving and bathing supplies. This shower or bath stool has non-skid legs and a moveable seating surface with storage space within the structure. Another example of the prior art in the field is the invention of Sultzbaugh as shown in U.S. Pat. No. 5,341,528. In this reference, a rigid, triangular foot rest for use in a shower is taught. The invention comprises an elongated body portion with a cross-sectional shape of a triangle for convenient placement of the support device in the corner of a shower. In U.S. Pat. No. 5,340,070, Soma discloses a leg shaving plate that is mounted in the corner of a shower stall as a fixture. The shaving plate body has a downward inclined foot portion of 15 to 20 degrees for receiving the foot of a person shaving a leg. Another example of prior art in the field is U.S. Pat. No. 7,310,837 by Reynolds et al. In this reference, Reynolds teaches a bathtub or shower seat that is formed to fit around the side wall of a bathtub. In one embodiment, the Reynolds invention disclosure teaches of a screw-type clamp for securing the seat to the sidewall of the bathtub. Yet another example of bathroom seats and footstools is U.S. Pat. No. 4,472,844 by Mace. Here, Mace teaches of a removable seat that may be mounted in a bathtub. The seat is adjustable in height to accommodate a variety of users.

The above-described references are representative of inventions designed for meeting the objective of providing comfortable seating or leg or foot support in a bath or shower environment. However, the prior art is lacking in any disclosure of a seat or foot rest that provides cushioned seating support while offering the safety feature of surface-gripping action. Further, the prior art fails to disclose a bath or shower seat that offers substantial planar contact with a variety of surfaces. In addition, the prior art is deficient in any teaching of a bath seat or leg support that offers the cushioned seating and surface grip support regardless of the orientation of the seat.

There exists a need in the art for a shower or bathtub seat that provides the comfort of cushioned seating while also offering the safety feature of surface gripping action. There further exists a need in the art for a shower or bathtub seat that provides substantial planar contact with the underlying support surface. There is also a need in the art for a seat that flexibly absorbs a user's weight for extra comfort and ease of use during typical hygiene functions performed during a shower or a bath.

SUMMARY OF THE INVENTION

The present invention provides a seat with concave projections that offer cushioned seating for a user on a top surface and gripping action on a bottom surface through deformation of projections. The seat is generally shaped as a cube with the gripping and cushioning projections formed on each of the six cube surfaces for ease of use and placement.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity.

DETAILED DESCRIPTION OF THE INVENTION

Figure 1:
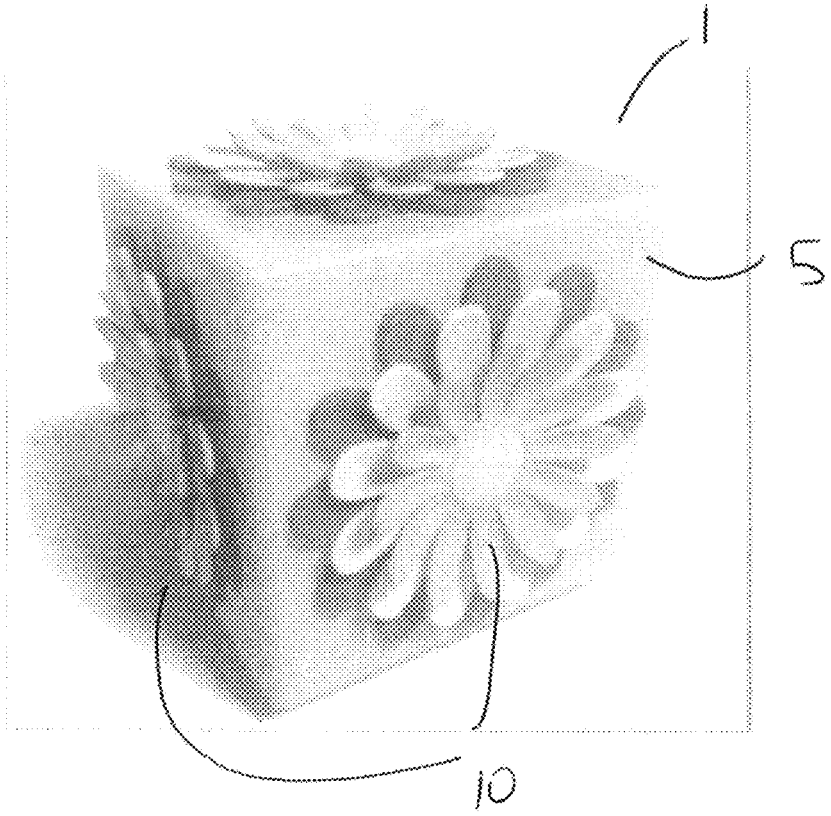
FIG. 1 is a perspective view of a preferred embodiment of the invention showing the top surface and two side of the seat of the present invention.
Figure 2:
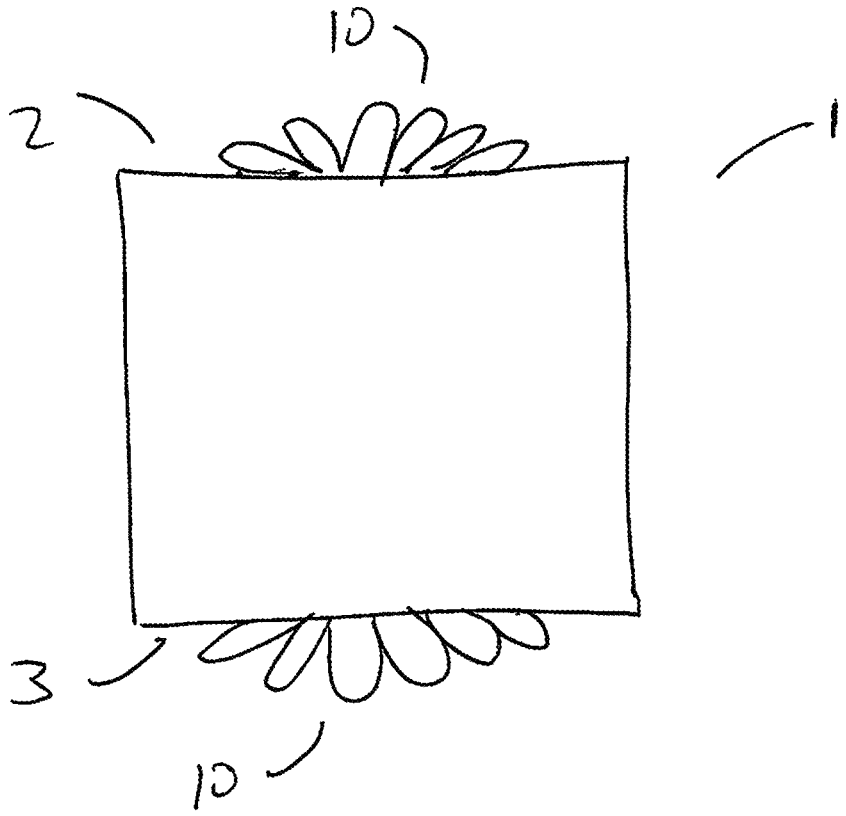
FIG. 2 is a side view of a preferred embodiment of the invention.

The present invention provides a seat with cushioned grip-control. The seat is useful in showers and bathtubs, but may also be used in both aquatic and non-aquatic environments. In one embodiment of the invention, referring to FIGS. 1 and 2, there is a seat body 1 having a top surface 2 and a bottom surface 3, the bottom surface 3 being located in a position opposite top surface 2. Top surface 2 and bottom surface 3 are substantially planar. Projections 10 extend distally from top surface 2 and bottom surface 3, away from the body of seat 1. FIG. 2 shows a side view of an embodiment of the invention, where projections 10 extend distal from the planar surfaces of top surface 2 and bottom surface 3. Projections 10 are made from an elastic-type material that may be deformed with applied pressure and then return to their original shape when the pressure is released. In this fashion, when seat 1 is set on a supporting surface such as a bathtub floor, any force applied to top surface 2 will deform the projections 10 of top surface 2, providing a cushion effect to the force. In addition, the applied force to top surface 2 is transferred through seat 1 to bottom surface 3, where the projections 10 of bottom surface 3 provide a gripping function on the floor. The dual cushioning and gripping functions of projections 10 provide seat 1 with both comfort to the user and safety from accidental sliding or movement of the seat.

Figure 3A:
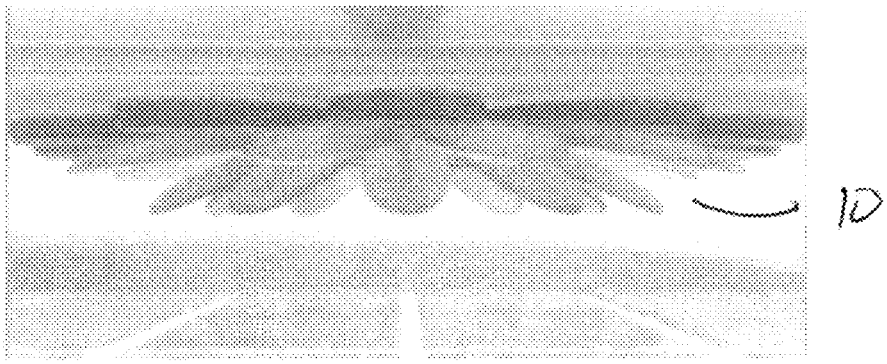
FIGS. 3*a* and 3*b* are a side view of a preferred embodiment of the invention showing the concave projections on a bottom surface before applying weight (FIG. 3*a*) and after applying weight (FIG. 3*b*) to the seat of the present invention.
Figure 3B:
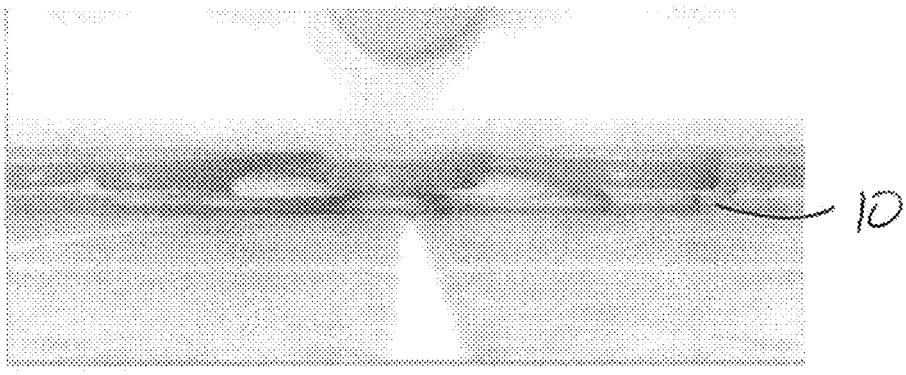

FIG. 3*a* illustrates projections 10 extending distally from the body of seat 1. When a force is applied to the seat, the projections 10 that are in contact with the supporting surface are flattened and spread out in a gripping fashion. FIG. 3*b* shows projections 10 engaged in gripping a supporting surface.

In one embodiment of the invention, projections 10 are formed into a concave shape. When a force or weight is applied and then released from seat 1, the concave-shaped projections 10 will first grip and then provide a loosening suction force to the supporting surface. In this manner, seat 1 can be safely presented on a supporting surface but not become rigidly affixed thereto.

Seat 1 can be made of a solid or a hollow material. If made of a solid material, it is preferred that the material be lightweight for easy portability. Suitable materials include but are not limited to fabric acrylic, polyester, nylon, polypropylene, and polyvinyl chloride. Non-absorbent foam materials are also suitable. It is preferred that seat 1 be made of a soft, semi-flexible material such that bottom surface 3 can conform to a variety of mildly constraining shapes, such as the more narrow end of a bathtub. By forming seat 1 of a flexible or soft material, the user may more comfortably engage in personal hygiene practices that may require the user to bend at the waist while sitting, such as washing the feet or shaving the legs.

In a preferred embodiment of the invention, seat 1 is shaped as a cube measuring 14 inches on a side. Seat 1 may be formed with a hollow core such that the seat may be inflated or deflated with air. Projections 10 are provided on each side of seat 1 such that any pair of opposing sides may function as the cushioning surface and the gripping surface.

In a more preferred embodiment of the present invention, seat 1 is shaped from a hollow material that can be inflated with air into the shape of a cube. Projections 10 are formed onto each face of the cube so that the seat may be set on any side and still provide a cushioning top surface and a gripping bottom surface. When formed into a six-sided cube with projections 10 on all sides, the user can place the cube into a bathtub or shower without regard to which particular side should be up. In addition to the convenience of multi-side placement, the six-sided cube with projections 10 on all sides also is also more aesthetically pleasing.

According to the present invention, projections 10 can be formed from any number of geometric and non-geometric configurations. The projections 10 of top surface 2 and bottom surface 3 may also be of different configurations to provide increased cushion to the top and selectable gripping function on the bottom of seat 1. In one embodiment, projections 10 are formed of concentric patterns of a general concave shape around a central point, such as flower petals or annular disks or saucers. It is found that the concentric patterns enhance both the cushioning ability of projections 10 as well as the overall effectiveness of projections 10 to releasably grip the supporting surface. In one variation of the present invention, projections 10 may be smaller and numerous or larger and less numerous, the primary requirement being that they both cushion and grip.

Figure 4:
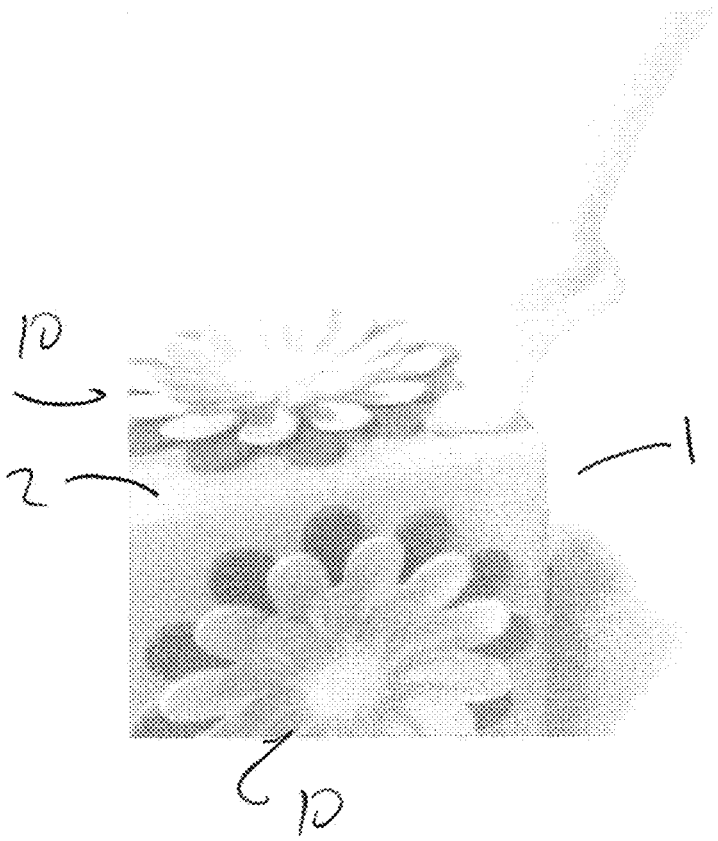
FIG. 4 is a perspective view of one embodiment of the seat of the present invention supporting a user's foot.
Figure 5:
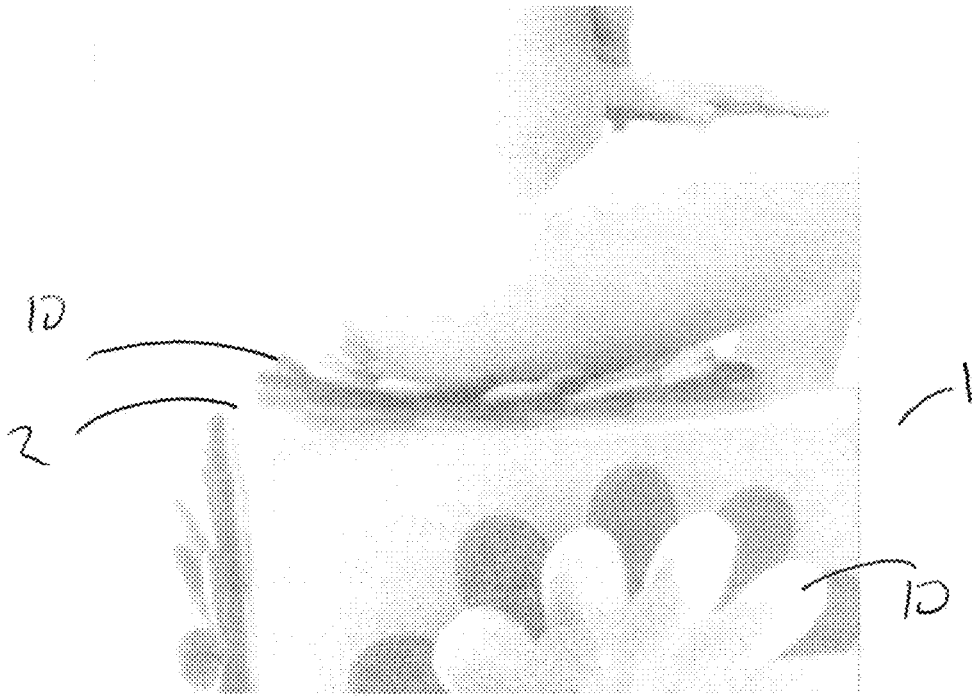
FIG. 5 is a perspective view of one embodiment of the seat of the present invention supporting a user's body.

Referring to FIG. 4, the present invention may also be used as a leg or foot support. Referring to FIG. 5, it can be seen that projections 10 form a cushioning surface for the user to sit on.

To provide increased gripping function without compromising comfort, the center of projections 10 may feature a more textured surface and also a more exaggerated extrusion from the surface of planar surface 5, such as with the center of a daisy.

Figure 6:
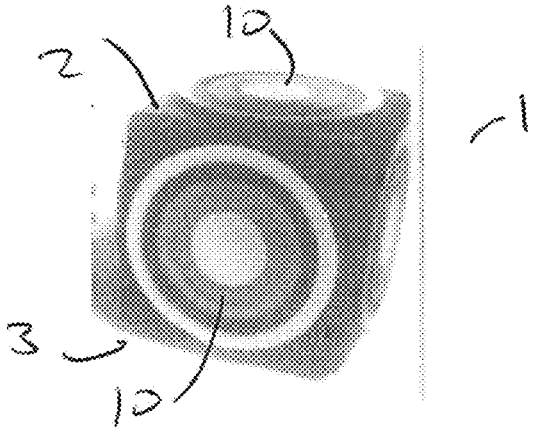
FIG. 6 is a perspective view of another embodiment of the seat of the present invention.

FIG. 6 illustrates another embodiment of the seat of the present invention with projections 10 forming annular, concave disks or saucers.

In another variation on the present invention, seat 1 may also include indentations of various sizes and shapes for securing or storing various bathing implements and supplies, such as razors, scrubs, soaps, and shampoos.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. A seat comprising:

a seat body having a top surface and a bottom surface, wherein said top surface and said bottom surface are substantially planar;

deformable concave projections on said top surface extending distal from said top surface and configured to cushion a user; and deformable projections on said bottom surface configured to grip a supporting surface when a force is applied to said seat.

2. The seat of claim 1, wherein said seat body is shaped as a cube.

3. The seat of claim 2, wherein said seat body is inflatable.

4. The seat of claim 2, wherein each face of said seat body has deformable projections configured to dually cushion a user and grip a supporting surface when a force is applied to said seat.

5. The seat of claim 4, wherein said deformable projections have a concave shape extending distal from said face.

6. The seat of claim 5, wherein each face of said seat body has the same pattern of deformable projections.

7. The seat of claim 1, wherein said seat body is made of flexible, water resistant material.

8. The seat of claim 1, wherein said bottom surface deformable projections have a concave shape extending distal from said bottom surface.

9. A seat comprising:

a flexible seat body shaped as a cube having six faces, with a top face, a bottom face, and four side faces;

deformable concave projections on said top face configured to cushion a user; and deformable projections on said bottom face configured to grip a supporting surface when a force is applied to said seat.

10. The seat of claim 9, wherein said deformable projections on said bottom face has a concave shape extending distal from said bottom face.

11. The seat of claim 9, wherein each of said six faces have deformable projections with a concave shape extending distal from said faces.

12. The seat of claim 11, wherein said projections are configured in a similar pattern on each face.

13. The seat of claim 12, wherein said projections are configured in concentric regions expanding out from a center point on each face.

14. The seat of claim 13, further comprising an exaggerated extrusion at said center point of each said face.

15. The seat of claim 14, wherein said extrusion is textured for additional gripping ability against a supporting surface.

16. The seat of claim 15, wherein said seat body is inflatable.

17. A personal hygiene seat comprising:

a flexible seat body shaped as a cube having six faces, each face having the same pattern of deformable projections configured to both cushion a user and grip a supporting surface; and indentations in said faces configured to store personal hygiene items.

18. The seat of claim 17, wherein said seat body is inflatable.

19. The seat of claim 18, wherein said seat body further comprises a handling strap.

* * * * *